US008403142B2

(12) United States Patent
Rose et al.

(10) Patent No.: US 8,403,142 B2
(45) Date of Patent: Mar. 26, 2013

(54) CONTAINER FOR SHIPPING FRAGILE PRODUCTS AND METHOD FOR MAKING THE SAME

(75) Inventors: Michael R. Rose, Franklin, TN (US); Spencer G. Miller, Shelbyville, TN (US); Ron G. Miller, Shelbyville, TN (US)

(73) Assignee: Rosemill Packaging Resources, LLC, Lewisburg, TN (US)

( * ) Notice: Subject to any disclaimer, the term of this patent is extended or adjusted under 35 U.S.C. 154(b) by 96 days.

(21) Appl. No.: 12/894,768

(22) Filed: Sep. 30, 2010

(65) Prior Publication Data

US 2012/0080346 A1 Apr. 5, 2012

(51) Int. Cl.
*B65D 85/48* (2006.01)

(52) U.S. Cl. ..... 206/448; 206/449

(58) Field of Classification Search ..... 206/454, 206/453, 448, 521, 449, 593, 523, 594, 592, 206/386, 451, 555
See application file for complete search history.

(56) References Cited

U.S. PATENT DOCUMENTS

| | | | | | |
|---|---|---|---|---|---|
| 3,985,231 | A * | 10/1976 | Farhat et al. | ..... | 206/448 |
| 4,320,836 | A * | 3/1982 | Brown et al. | ..... | 206/451 |
| 4,353,466 | A * | 10/1982 | Pater | ..... | 206/453 |
| 5,105,946 | A | 4/1992 | McDowell | | |
| 5,626,231 | A * | 5/1997 | Kwong et al. | ..... | 206/600 |
| 5,676,066 | A | 10/1997 | Cavalier et al. | | |
| 5,803,257 | A * | 9/1998 | Bartholomew | ..... | 206/454 |
| 5,813,536 | A * | 9/1998 | Bartholomew | ..... | 206/449 |
| 6,290,064 | B1 * | 9/2001 | Kuhn et al. | ..... | 206/600 |
| 6,742,663 | B2 | 6/2004 | Chubb | | |
| 7,441,658 | B2 | 10/2008 | McDowell | | |
| 2004/0016669 | A1 * | 1/2004 | Allison | ..... | 206/448 |
| 2006/0186118 | A1 | 8/2006 | Stojak et al. | | |
| 2008/0283583 | A1 | 11/2008 | Hall | | |
| 2009/0301916 | A1 | 12/2009 | McDowell | | |
| 2010/0000894 | A1 * | 1/2010 | Noda et al. | ..... | 206/386 |

* cited by examiner

*Primary Examiner* — Jacob K Ackun
*Assistant Examiner* — Jenine Pagan
(74) *Attorney, Agent, or Firm* — Armstrong Teasdale LLP

(57) ABSTRACT

A container for transporting glass sheets includes a bottom structure having a front edge and a back wall and first and second side walls extending upwardly from the bottom structure. The container also includes a floor support mechanism coupled to the bottom structure. The floor support mechanism includes a floor support member extending substantially horizontally from the back wall a first distance proximate to the front edge of the bottom structure. The floor support mechanism also includes a foam rail support member coupled to the floor support member. The foam rail support member extends substantially horizontally from the back wall a second distance proximate to the front edge of the bottom structure. The floor support mechanism further includes a foam rail coupled to the foam rail support member. The foam rail extends substantially horizontally from approximately the back wall a third distance that is less than the second distance.

20 Claims, 12 Drawing Sheets

CONTAINER FOR SHIPPING FRAGILE PRODUCTS AND METHOD FOR MAKING THE SAME

BACKGROUND OF THE INVENTION

The field of the invention relates generally to a container for shipping frangible and fragile articles and more particularly, to a container for transporting a plurality of curved glass sheets, such as windshields for vehicles.

Containers for shipping glass or plexiglass sheets, such as windshields used in automobiles and trucks, are typically corrugated structures or wood crates (or a combination thereof) supported on a wood pallet. The containers are pre-assembled or occasionally shipped in components to the windshields manufacturer and are set up or assembled on-site. In at least some known glass shipping containers, bottom support and side devices include sufficient features to securely support the glass and withstand the rigors of transportation and be capable of stacking to maximize warehouse space. This includes providing a snug fit for the glass. Further, in at least some known glass shipping containers, the bottom support and side devices are constructed to at least partially withstand banding pressures from straps or bands utilized in shipping.

In at least some known cases, shipping the glass sheets in an upright position increases a propensity for the glass sheets to shift during transit, thereby stressing the banding and the portions of the container in contact with the banding. Such increased wear may decrease a life expectancy of the shipping container, and may allow for some shifting of the glass sheets resulting in at least some damage to the glass, as well as the shipping container. Moreover, some glass shipping containers provide for placing the glass sheets directly on the bottom pallet, wherein localized induced weight stresses may shorted an expected lifespan of the shipping container's bottom pallet. Further, the positioning of banding around the container is often performed in a haphazard manner because the container does not provide adequate access for routing the banding when the container is at least partially loaded with windshields.

BRIEF DESCRIPTION OF THE INVENTION

In one aspect, a container for transporting glass sheets. The container includes a bottom structure having a front edge and a back wall extending upwardly from the bottom structure. The container also includes a first side wall coupled to the back wall and extending upwardly from the bottom structure. The container further includes a second side wall opposite the first side wall coupled to the back wall and extending upwardly from the bottom structure. The container also includes a floor support mechanism coupled to the bottom structure. The floor support mechanism includes at least one floor support member extending substantially horizontally from the back wall a first distance proximate to the front edge of the bottom structure. The floor support mechanism also includes at least one foam rail support member coupled to the at least one floor support member. The at least one foam rail support member extends substantially horizontally from the back wall a second distance proximate to the front edge of the bottom structure. The floor support mechanism further includes at least one foam rail coupled to the at least one foam rail support member. The at least one foam rail extends substantially horizontally from approximately the back wall a third distance that is less than the second distance. The floor support mechanism facilitates transferring a load exerted by the glass sheets to at least a portion of the bottom structure.

In another aspect, a container for transporting glass sheets is provided. The container defines an internal volume and includes a bottom structure and a back wall extending upwardly from the bottom structure. The container also includes a first side wall coupled to the back wall and extending upwardly from the bottom structure. The container further includes a second side wall opposite the first side wall coupled to the back wall and extending upwardly from the bottom structure. The container also includes a back support structure coupled to the back wall and configured to constrain a plurality of glass sheets. The back support member includes at least one back support member. The at least one back support member extends in a substantially vertical direction. The back support member also includes at least one offset member extending inwardly a distance from the at least one back support member toward the internal volume of the container. The back support member also includes at least one foam rail coupled to a foam rail support member. The foam rail support member is coupled to the at least one offset member.

In yet another aspect, a method of assembling a container for transporting glass sheets is provided. The container defines an internal volume. The method includes providing a bottom structure having a front edge. The method also includes coupling a back wall to the bottom structure and extending the back wall upwardly therefrom. The method further includes coupling a first side wall to the back wall and extending the first side wall upwardly from the bottom structure. The method also includes coupling a second side wall to the back wall and extending the second side wall upwardly from the bottom structure. The first and second side walls are opposite to each other. The method further includes assembling a floor support mechanism that includes coupling at least one floor support member to the bottom structure. The at least one floor support member extends substantially horizontally from the back wall a first distance proximate to the front edge of the bottom structure. The method also includes coupling at least one foam rail support member to the at least one floor support member. The at least one foam rail support member extends substantially horizontally from the back wall a second distance proximate to the front edge of the bottom structure. The method further includes coupling a foam rail to the at least one foam rail support member. The at least one foam rail extends substantially horizontally from approximately the back wall a third distance that is less than the second distance.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The term "glass sheets" as used herein includes sheets made from plexiglass, glass, plastic, or other similar frangible or fragile materials, and/or combinations thereof, which are typically used to make windshields or other windows for vehicles, or glass sheets for any other application. While the windshields as alluded to herein are typically curved, the shipping container described herein may be used with glass sheets of any configuration and/or orientation.

The present invention provides a glass shipping container formed from a plurality of wooden members and corrugated cardboard. The shipping container includes a bottom, or floor support mechanism that facilitates supporting the transported glass sheets above a bottom support pallet. The floor support mechanism also enables banding straps to be routed around the glass sheets, through holes and grooves formed in an oriented strand board (OSB) member, and to an outer anchoring portion of the shipping container, thereby improving the loading and securing the glass sheets therein. The floor support mechanism is further configured to strengthen the shipping container while shifting induced weight forces though the reinforced portions of the OSB member and to a reinforced portion of the bottom support pallet. The shipping container also includes an inclined back support mechanism that facilitates stacking glass sheets within the shipping container such that a substantial portion of the induced weight forces are transferred to the rear of the shipping container. The shipping container further includes a top support member that strengthens the shipping container and reduces the potential for damage to the glass sheets during transport.

Figure 1:
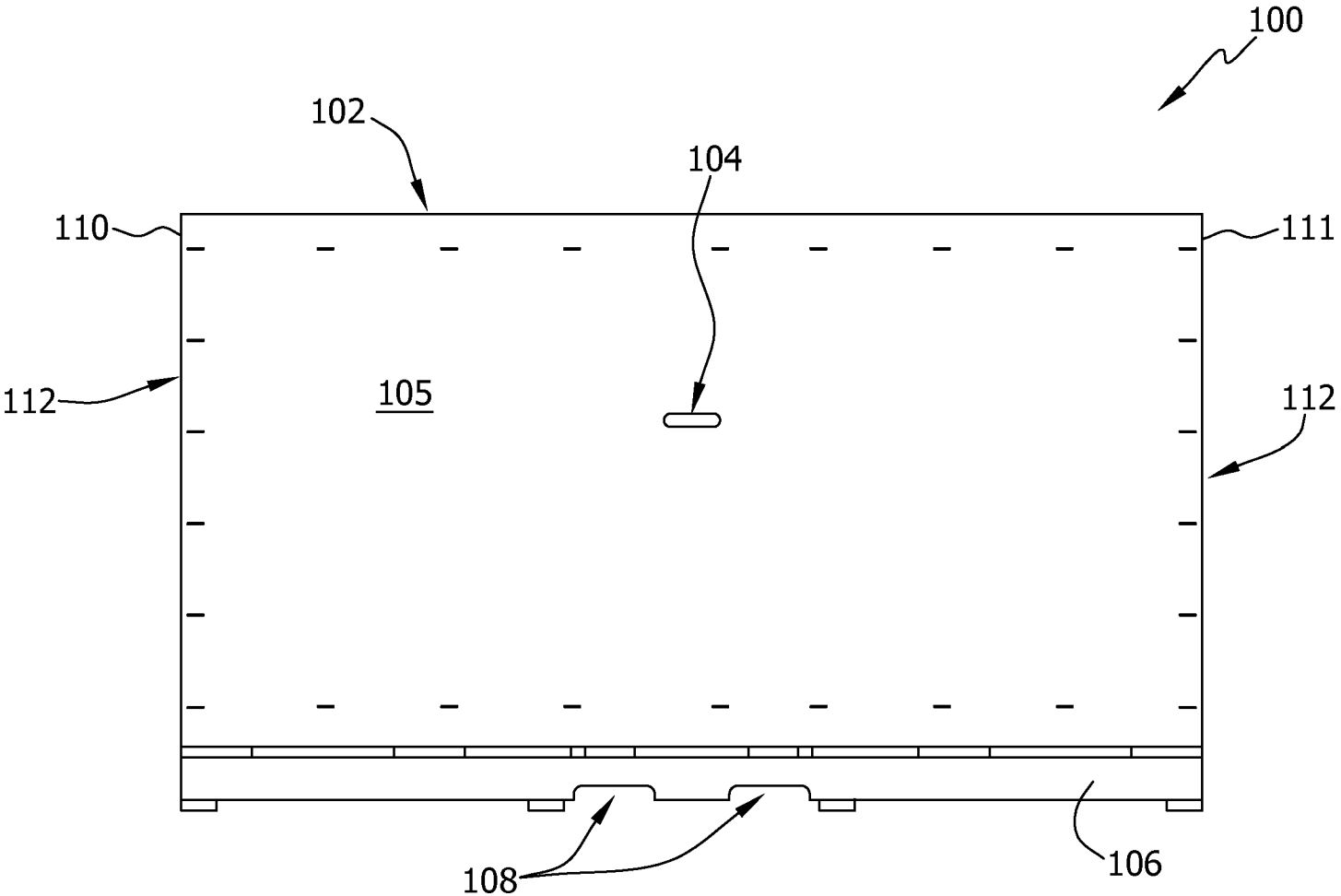
FIG. 1 is a front view of a glass shipping container according to a first embodiment of the present invention.

Referring now to the drawings, and more specifically to FIG. 1, which is a front view of an example embodiment of a container for transporting glass sheets, that is, a glass shipping container 100. Glass shipping container 100 includes a removable front wall, or panel 102. Front panel 102 includes at least one finger-grip opening 104 for enabling a user to easily remove front panel 102, thereby improving access to the interior volume defined therein for loading and unloading container 100. In the exemplary embodiment, front panel 102 includes a corrugated cardboard wall 105. Shipping container 100 also includes a bottom structure, or a bottom support pallet 106 that is manufactured from a plurality of wood members (not shown) arranged in any configuration that enables operation of shipping container 100 as described herein. Support pallet 106 defines a plurality of fork openings 108 that facilitate transport by a fork-type transporting mechanism including, without limitation, a fork lift truck and a forked hand-cart. Support pallet 106 and front panel 102 are coupled by standard fastening mechanisms (not shown) that include, without limitation, screws, bolts, and nails. Shipping container 100 further includes a plurality of sidewalls 112, wherein each sidewall 112 includes a front portion (not shown in FIG. 1) and each sidewall extends vertically upward from support pallet 106. In the exemplary embodiment, removable front panel 102 and sidewalls 112 define a first front edge 110 and a second front edge 111, and cardboard wall 105 extends therebetween. Shipping container 100 is configured to constrain and protect a plurality of glass sheets (not shown) during transport.

In general, in the embodiments described herein, heat-treated soft wood, that is, southern yellow pine, is used for the wooden components unless otherwise stated. Alternatively, any wood materials that enable operation of shipping container 100 as described herein are used.

Figure 2:
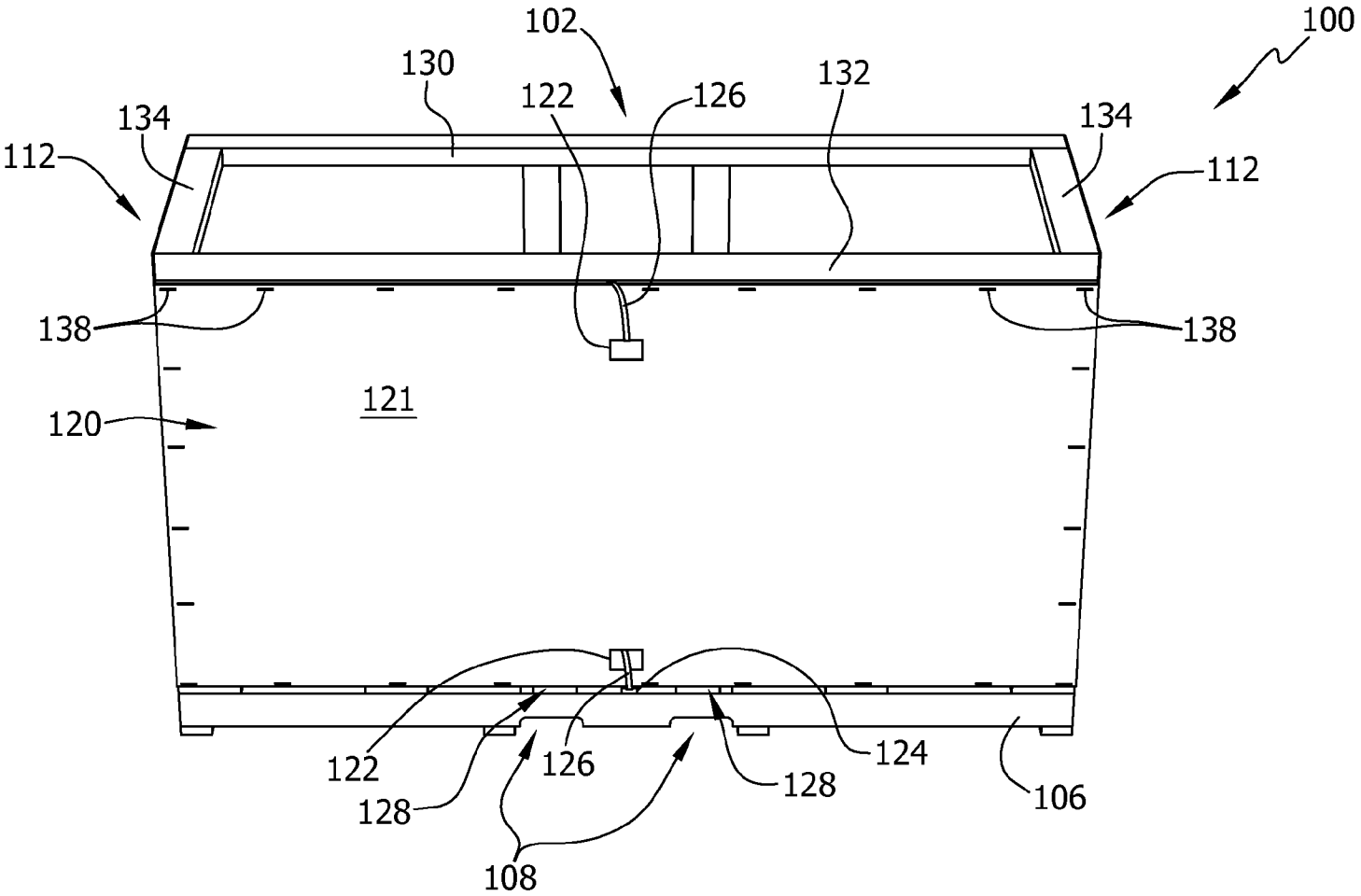
FIG. 2 is a perspective back view of the glass shipping container shown in FIG. 1.

FIG. 2 is a perspective back view of glass shipping container 100. In the exemplary embodiment, glass shipping container 100 includes a back wall, or panel 120 that extends upward from support pallet 106. In the exemplary embodiment, back panel 120 includes a corrugated cardboard wall 121. Back panel 120 defines a plurality of banding openings 122 and support pallet 106 defines at least one banding opening 124. Openings 122 and 124 receive at least one banding 126 therethrough, wherein bandings 126 facilitate securing glass panels (not shown) within shipping container 100 during transport. Shipping container 100 also includes at least one banding aperture 128 defined therein, wherein apertures 128 extend from a position near front panel 102 to back panel 120. Apertures 128 facilitate extending banding material (not shown) from front to back to facilitate securing glass panels therein.

In the exemplary embodiment, front panel 102 includes an upper support member 130 and back panel 120 includes an upper support member 132 that is substantially parallel to support member 130, that is, substantially horizontal. Support members 130 and 132 are fabricated from substantially unitary 2-inch by 4-inch wood, that is, a 2×4. Also, in the exemplary embodiment, each of sidewalls 112 includes a support member 134, wherein both support members 134 are substantially parallel to each other. Support members 134 are fabricated from substantially unitary 2-inch by 2.25-inch wood, that is, a 2×2¼ and are coupled to support members 130 and 132 by standard fastening mechanisms (not shown) that include, without limitation, screws, bolts, and nails. Support members 130, 132, and 134 define a substantially open top arrangement for shipping container 100. Moreover, in the exemplary embodiment, back panel 120 is coupled to support members 132 and 134 via a plurality of staples 138. Alternatively, back panel 120 is coupled to support members 132 and 134 by standard fastening mechanisms (not shown) that include, without limitation, staples, screws, bolts, and nails.

Figure 3:
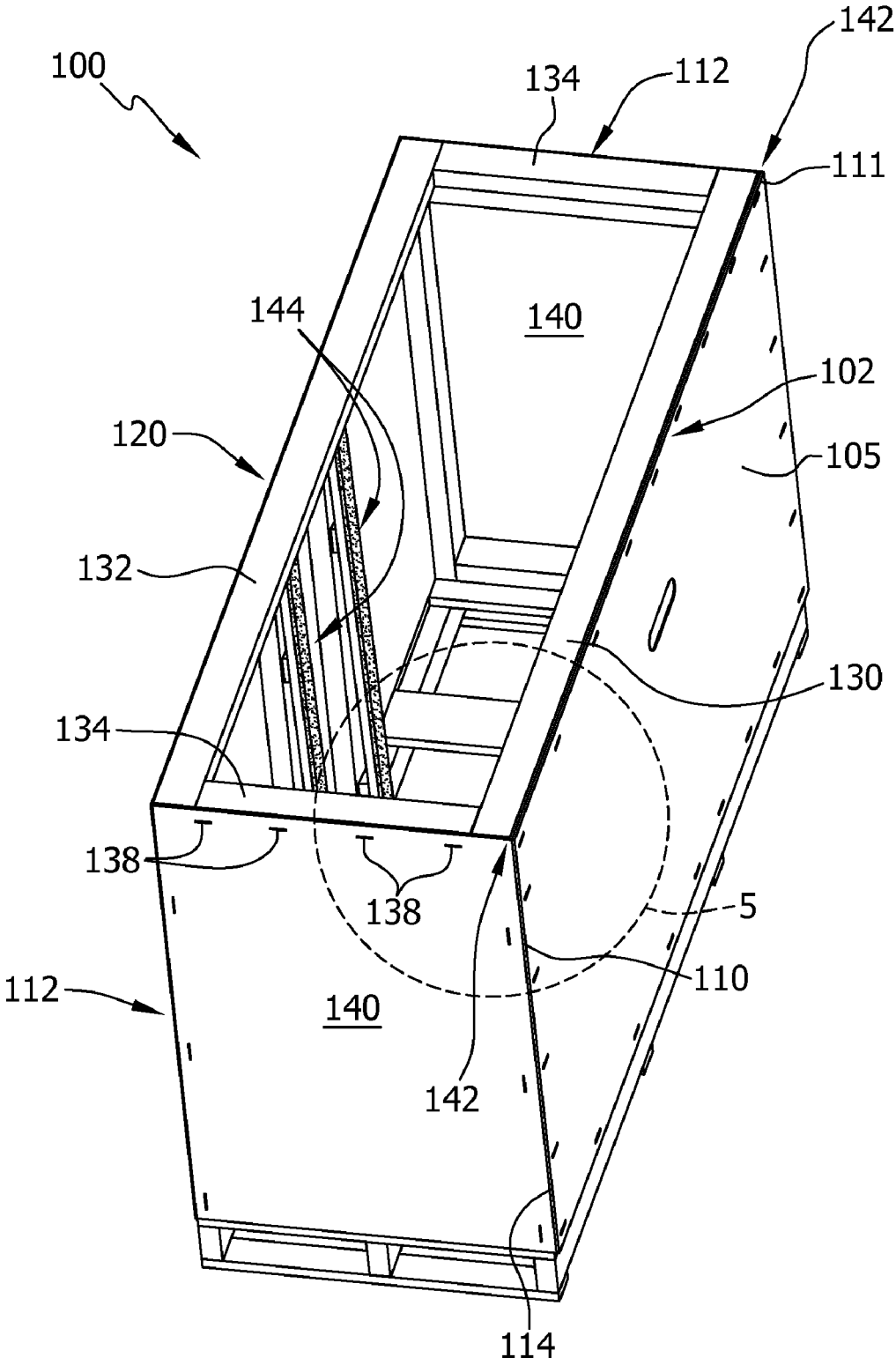
FIG. 3 is a perspective top view of the glass shipping container shown in FIGS. 1 and 2.

FIG. 3 is a perspective top view of glass shipping container 100. In the exemplary embodiment, glass shipping container 100 includes a plurality of side panels 140 that are fabricated of corrugated cardboard and are coupled to support members 132 and 134 via a plurality of staples 138 to form sidewalls 112. Alternatively, each side panel 140 is coupled to support members 132 and 134 by standard fastening mechanisms (not shown) that include, without limitation, staples, screws, bolts, and nails. Side panels 140 are not coupled to support member 130, thereby facilitating removability features of front panel 102. Front portion 114 of sidewalls 112, each side panel 140, and cardboard wall 105 cooperate to define a corrugated lip 142 that facilitates holding support member 130 in place when front panel 102 is inserted into shipping container 100. Also, in the exemplary embodiment, glass shipping container 100 includes at least one angled back rest, that is, back support mechanism 144 that facilitates support of glass plates (not shown) in shipping container 100 during transport.

Figure 4:
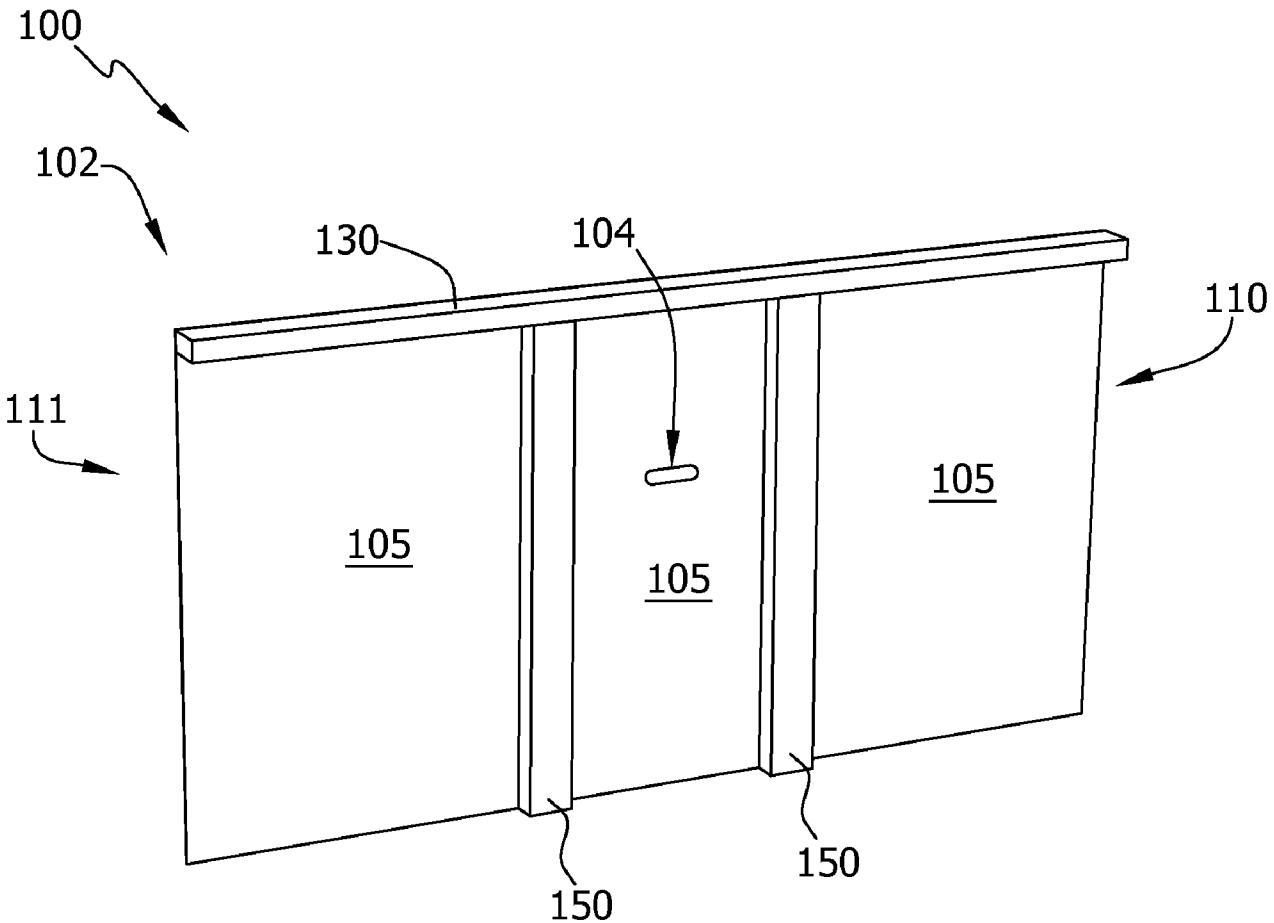
FIG. 4 is a perspective view of a front panel that is used with the glass shipping container shown in FIG. 1 and removed therefrom.

FIG. 4 is a perspective view of front panel 102 of glass shipping container 100 and removed therefrom. This perspective view shows the interior surface of front panel 102. Front panel 102 includes a plurality of vertical support members 150 that facilitate stabilizing and strengthening front panel 102. Support members 150 are made of unitary wood 2×4s and are coupled to corrugated cardboard wall 105 via any coupling mechanism that enables operation of shipping container 100 as described herein including, without limitation, adhesives and staples.

Figure 5:
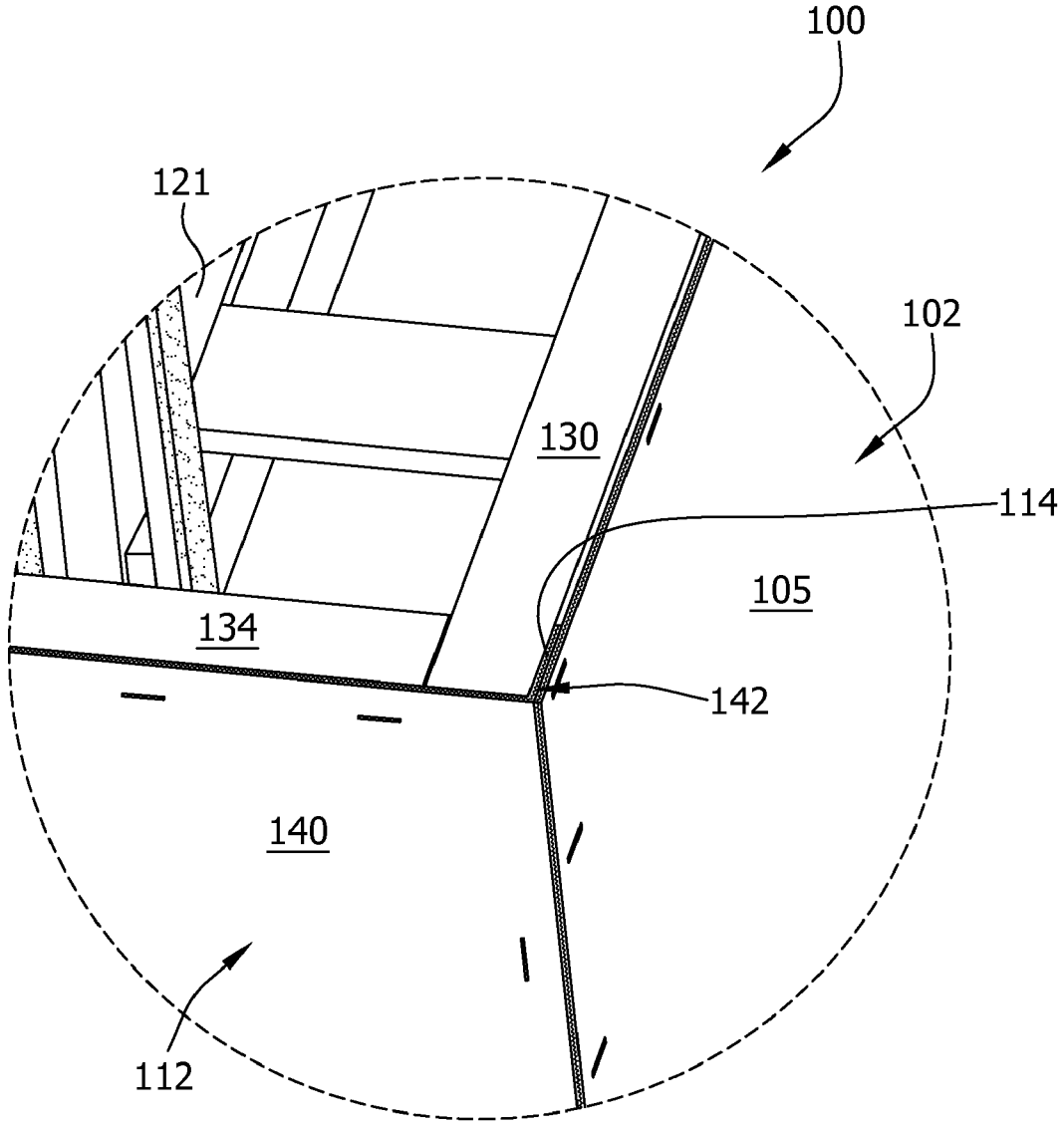
FIG. 5 is a perspective view of a corrugated lip that is used with the glass shipping container shown in FIG. 3 and taken along area 5.
Figure 6:
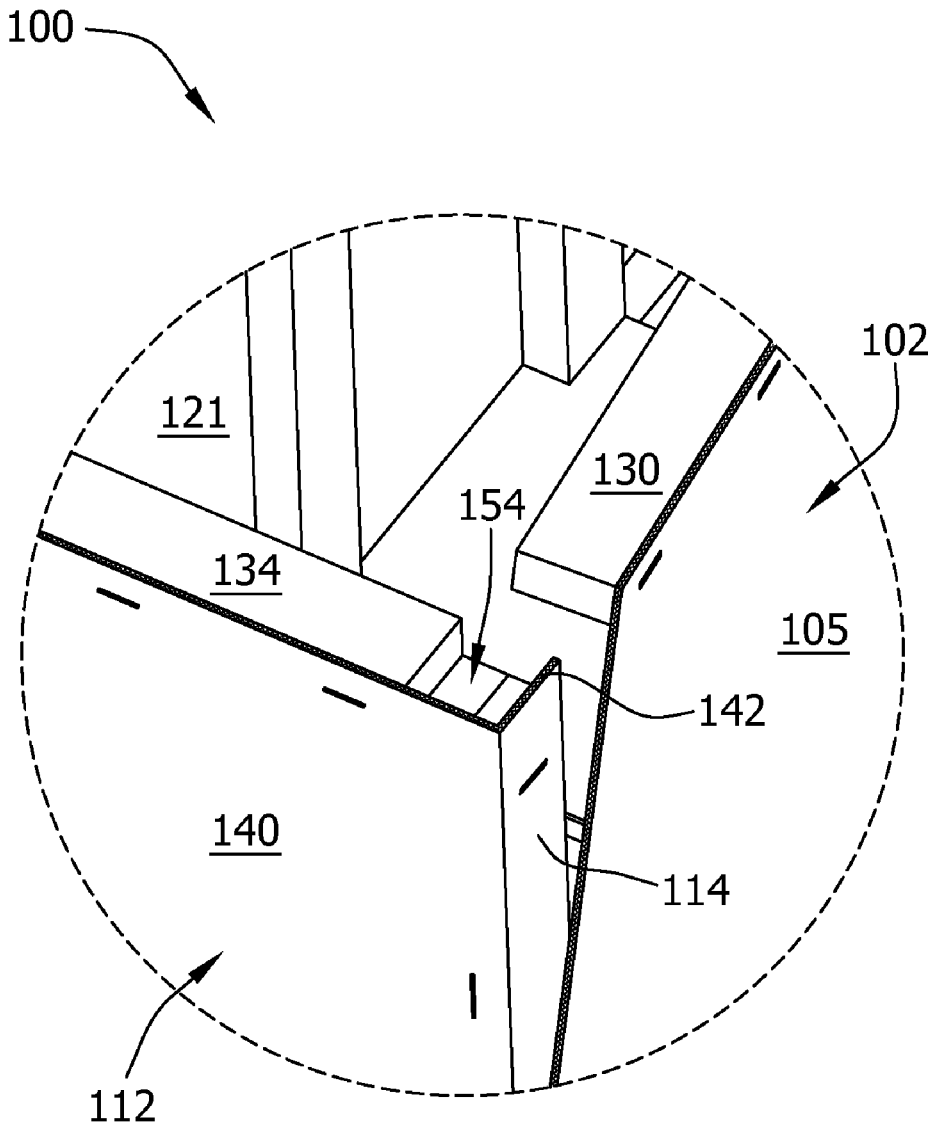
FIG. 6 is a perspective view of the corrugated lip shown in FIG. 5 with the front panel shown in FIG. 4 partially removed.

FIG. 5 is a perspective view of corrugated lip 142 of glass shipping container 100 taken about area 5 (shown in FIG. 3). FIG. 6 is a perspective view of corrugated lip 142 with the front panel 102 partially removed. Front portion 114 of sidewall 112 is folded over to be substantially perpendicular to side panel 140 and parallel to cardboard wall 105. In the exemplary embodiment, front portion 114 is coupled to a front corner vertical support member (not shown in FIGS. 5 and 6) via any coupling mechanism that enables operation of shipping container 100 as described herein including, without limitation, adhesives and staples. Also, in the exemplary embodiment, cardboard wall 105 is coupled to front portion 114 via any coupling mechanism that enables operation of shipping container 100 as described herein including, without limitation, adhesives and staples. Support member 134, side panel 140, front portion 114, cardboard wall 105, and corrugated lip 142 at least partially form a cavity 154 that receives a portion of front support member 130.

Figure 7:
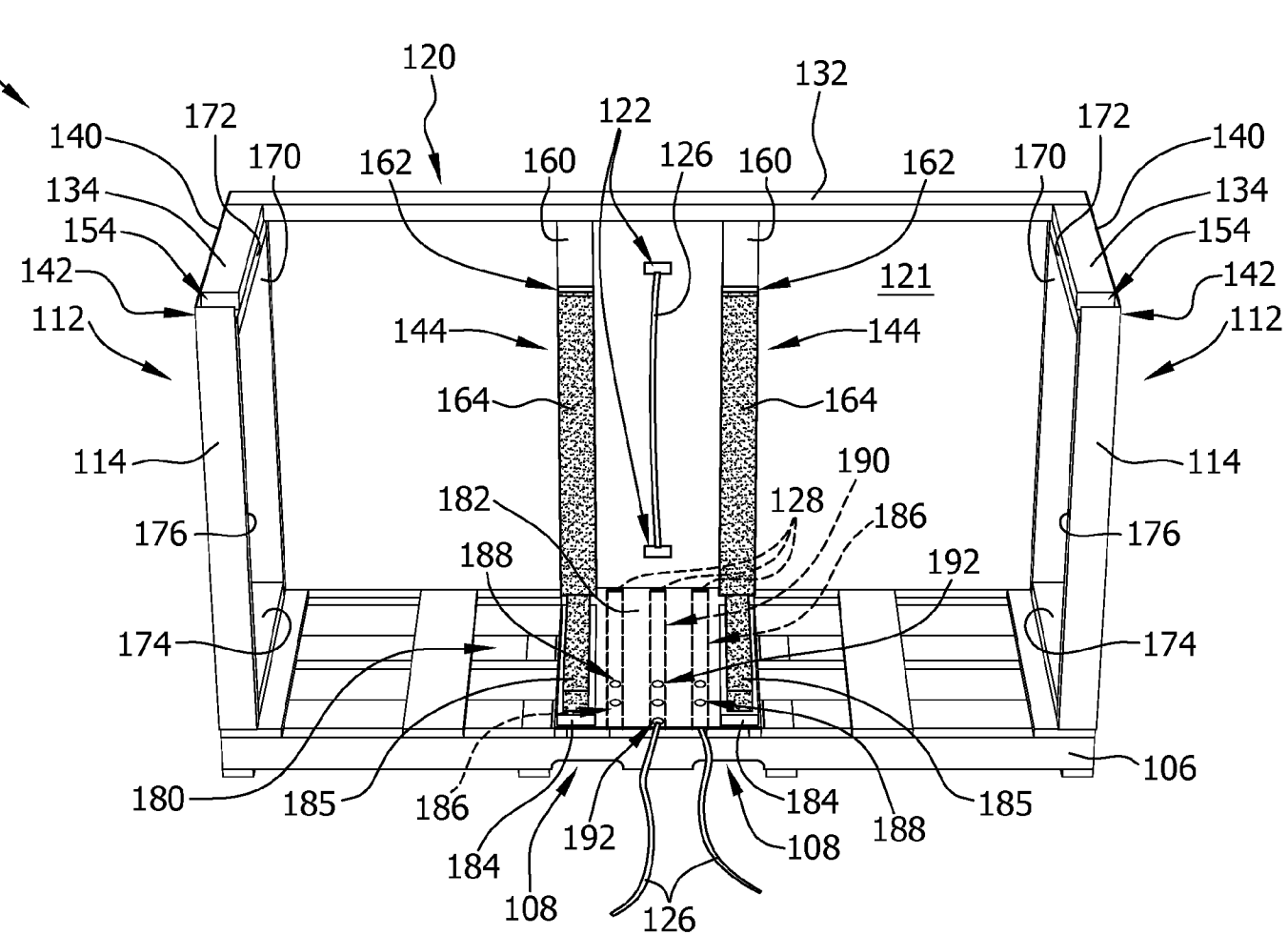
FIG. 7 is a front view of the glass shipping container shown in FIG. 1 with the front panel shown in FIG. 4 removed therefrom.

FIG. 7 is a front view of glass shipping container 100 with front panel 102 (shown in FIG. 4) removed therefrom. In the exemplary embodiment, at least one back support mechanism 144 is coupled to back panel 120, or more specifically, coupled to corrugated cardboard wall 121 and back support member 132 by any means that enables operation of shipping container 100 as described herein.

Also, in the exemplary embodiment, glass shipping container 100 includes two back support mechanisms 144. Alternatively, any number of back support mechanisms 144 is used to enable operation of shipping container 100 as described herein, including, without limitation, one and three mechanisms 144. In the exemplary embodiment, each back support mechanism 144 is an angled backrest that has an approximately five degree incline (not shown in FIG. 7) that is facilitated by a plurality of offsets (not shown in FIG. 7, however, described further below). Each back support mechanism 144 includes a substantially vertical back support member 160 that is a wooden 2×4. Each member 160 extends from horizontal back support member 132 to a floor support mechanism 180 (discussed further below). Moreover, each member 160 is coupled to at least one of corrugated cardboard wall 121, back support member 132, and/or floor support mechanism 180 by any means that enables operation of shipping container 100 as described herein.

Each back support mechanism 144 also includes a foam rail support member 162 (shown in phantom in FIG. 7) coupled to vertical back support member 160 by any means that enables operation of shipping container 100 as described herein including, without limitation, fastening hardware and adhesives. Each foam rail support member 162 is a wooden 1-inch by 4-inch member, that is, a wooden 1×4 that extends from a predetermined distance below horizontal back support member 132 to floor support mechanism 180. Each back support mechanism 144 further includes at least one foam rail 164 coupled to foam rail support member 162 by any means that enables operation of shipping container 100 as described herein including, without limitation, fastening hardware and adhesives. Each foam rail 164 extends from a predetermined distance below horizontal back support member 132 to floor support mechanism 180. In the exemplary embodiment, foam rail 164 and foam rail support member 162 have substantially similar vertical lengths.

Further, in the exemplary embodiment, glass shipping container 100 includes a plurality of rear corner vertical support members 170, wherein each support member 170 is a unitary 2×2¼ wooden member. Each support member 170 is coupled to corrugated cardboard wall 121 and a side panel 140 by any means that enables operation of shipping container 100 as described herein including, without limitation, staples and adhesives. Moreover, shipping container 100 includes a plurality of upper horizontal side support members 172 and a plurality of lower horizontal side support members 174. Each of support members 172 and 174 is also a unitary 2×2¼ wooden member that is coupled to a support member 170 by any means that enables operation of shipping container 100 as described herein including, without limitation, fastening hardware and adhesives. Each of members 172 and 174 may be coupled to a side panel 140 by any means that enables operation of shipping container 100 as described herein including, without limitation, staples and adhesives. Furthermore, each upper horizontal side support member 172 is coupled to an adjacent sidewall support member 134 and each horizontal side support member 174 is coupled to bottom support pallet 106, wherein such coupling is performed by any means that enables operation of shipping container 100 as described herein including, without limitation, fastening hardware and adhesives.

Moreover, in the exemplary embodiment, glass shipping container 100 includes a plurality of front corner vertical support members 176, wherein each support member 176 is a unitary 2×2¼ wooden member. Each support member 176 is coupled to one support member 172 and one support member 174 by any means that enables operation of shipping container 100 as described herein including, without limitation, fastening hardware and adhesives. Support members 176 may be coupled to a side panel 140 and front portion sidewalls 114 by any means that enables operation of shipping container 100 as described herein including, without limitation, staples and adhesives.

Use of unitary 2×2¼ wooden members for support members 170, 172, 174, and 176 facilitate increasing a storage/shipping region within glass shipping container 100 and access thereto in contrast to standard wooden 2×4s and 2×3s. Moreover, sidewalls 114 may or may not include additional support members.

Also, in the exemplary embodiment, glass shipping container 100 includes floor support mechanism 180. Floor support mechanism 180 includes a floor support member, that is, a horizontal support board 182 that is fabricated from oriented strand board (OSB) material, wherein OSB material provides sufficient strength and durability for repeated shipping use with a relatively low cost as compared to other materials, such as plywood and plastic. Horizontal support board 182 is coupled to bottom support pallet 106 by any means that enables operation of shipping container 100 as described herein including, without limitation, fastening hardware and adhesives. Also, horizontal support board is substantially laterally centered on pallet 106 and extends approximately from back panel 120 to front panel 102.

Floor support mechanism 180 also includes at least one of unitary 1×4 wooden foam rail support member 184 (two shown in phantom in FIG. 7) that extend approximately from vertical foam rails 164 to proximately front panel 102. Foam rail support members 184 are coupled to horizontal support board 182 by any means that enables operation of shipping container 100 as described herein including, without limitation, fastening hardware and adhesives. Foam rail support members 184 may also be coupled to an adjacent vertical support member 162 by any means that enables operation of shipping container 100 as described herein including, without limitation, fastening hardware and adhesives.

Floor support mechanism 180 further includes at least one foam rail 185 that extends proximately from vertical foam rails 164. Foam rail 185 is coupled to a foam rail support member 184 by any means that enables operation of shipping container 100 as described herein including, without limitation, fastening hardware and adhesives. Further, in the exemplary embodiment, glass shipping container 100 includes two rail support members 184 and two foam rails 185. Alternatively, any number of support members 184 and rails 185 are used to enable operation of shipping container 100 as described herein, including, without limitation, one and three. In the exemplary embodiment, foam rail support member 182 extends to a point between a front edge (not shown in FIG. 7) of foam rail 185 and an outer front edge (not shown in FIG. 7) of horizontal support board 182. Such configuration of support member 182 and foam rail 185 facilitates lifting glass sheets (not shown) away from horizontal support board 182, thereby facilitating extending a useful life of board 182 by reducing a potential for wear of board 182 due to direct contact between the glass sheets and board 182. Moreover, since the glass sheets rest on foam rails 185, a substantial portion of weight forces induced by the glass is transferred to the foam, such foam being easy and inexpensive to replace.

Floor support mechanism 180 further includes a plurality of banding guide channels, or grooves 186 that are operatively coupled to a plurality of banding access apertures, or holes 188, wherein both grooves 186 and holes 188 are defined within horizontal support board 182. Further, grooves 186 define banding apertures 128, therefore apertures 128 are also defined in horizontal support board 182. Therefore, holes 188 are operatively coupled to apertures 128 via grooves 186, facilitate channeling banding 126 throughout the bottom portion of glass shipping container 100, thereby facilitating support of glass sheets (not shown) therein throughout transit. One embodiment of shipping container 100 includes two holes 188 for each groove 186, wherein each grove is inboard from, and adjacent to, a foam rail 184. An alternative embodiment of shipping container 100 includes three holes 192 for a single groove 190, wherein both holes 192 and groove 190 are aligned about an approximate center of horizontal support board 182. Further, alternatively, any number of holes 188 and 192 and any number of grooves 186 and 190 are formed within horizontal support board 182 that enables operation of shipping container 100 as described herein.

Figure 8:
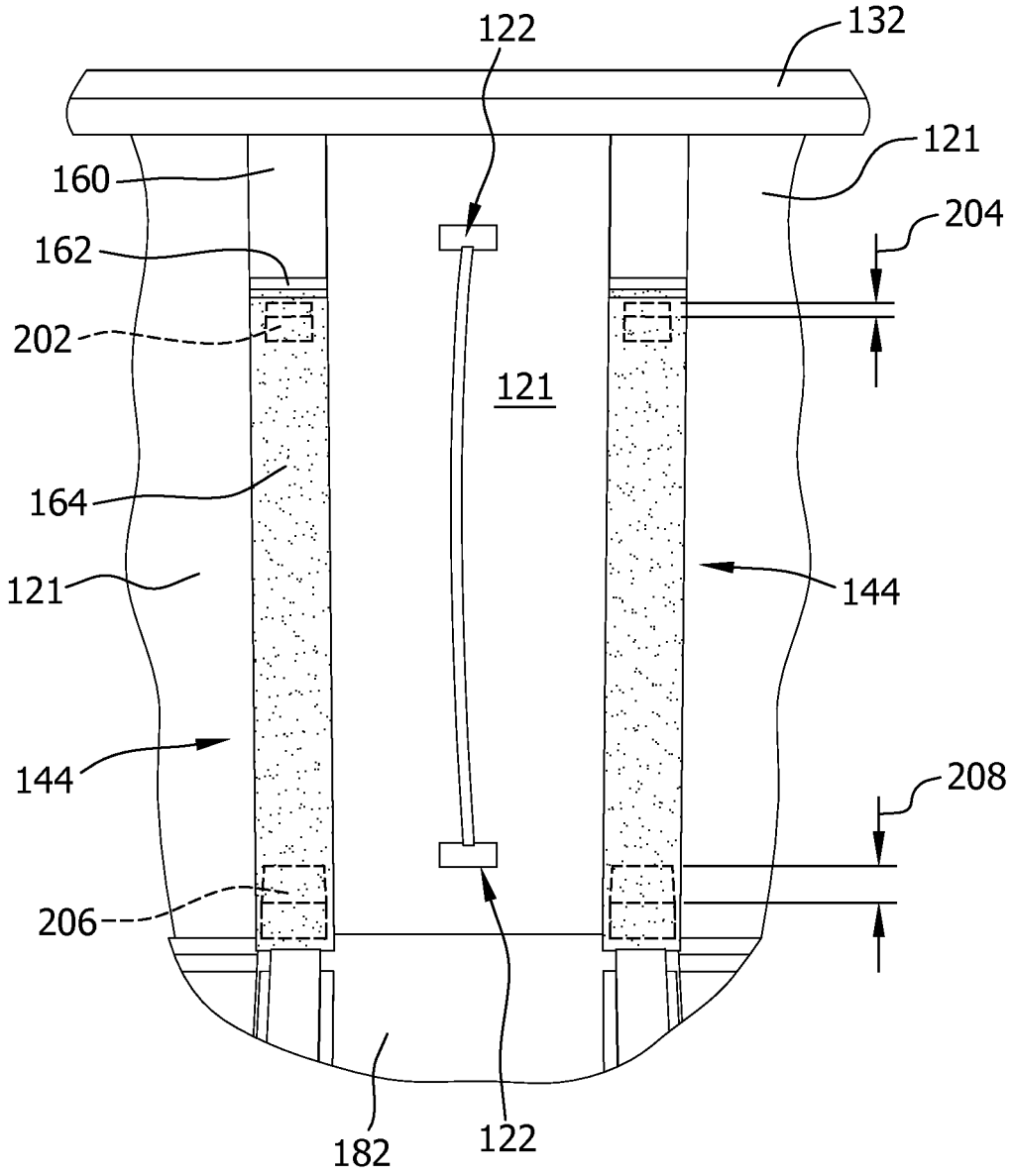
FIG. 8 is a front view of a back support mechanism that is used with the glass shipping container shown in FIG. 1.
Figure 9:
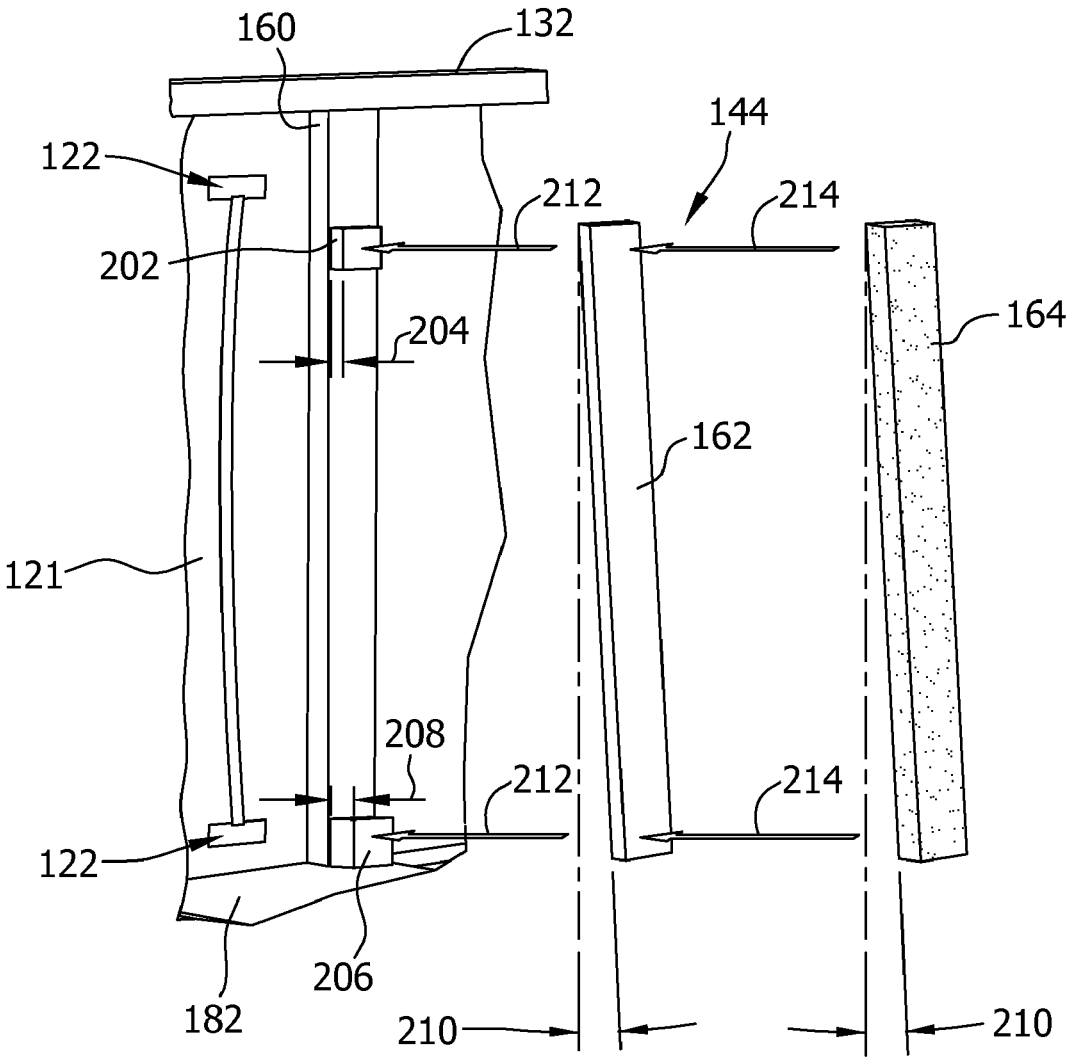
FIG. 9 is a perspective side view of the back support mechanism shown in FIG. 8.

FIG. 8 is a front view of back support mechanism 144 that is used with glass shipping container 100 (shown in FIG. 1). FIG. 9 is a perspective side view of back support mechanism 144. In the exemplary embodiment, back support mechanism 144 includes a first offset member 202 extending a first offset distance 204 from vertical back support member 160 into the interior volume of shipping container 100. First offset member 202 is coupled to vertical back support member 160 by any means that enables operation of shipping container 100 as described herein including, without limitation, fastening hardware and adhesives, proximate to a top of foam rail support members 162 and foam rails 164.

Back support mechanism 144 also includes a second offset member 206 extending a second offset distance 208 from vertical back support member 160 into the interior volume of shipping container 100. Offset member 206 rests upon and is coupled to horizontal support board 182 by any means that enables operation of shipping container 100 as described herein including, without limitation, fastening hardware and adhesives. Also, offset member 206 rests against vertical back support member 160 such that offset member 206 is coupled to vertical back support member 160 by a pressure, or friction fit. Alternatively, offset member 206 is coupled to vertical back support member by any means that enables operation of shipping container 100 as described herein including, without limitation, fastening hardware and adhesives. Second distance 208 is greater than first distance 204, thereby defining an offset angle 210 with respect to vertical. In the exemplary embodiment, offset angle 210 has a value of approximately five degrees. Alternatively, offset angle 210 has any value that enables operation of shipping container 100 as described herein. Foam rail support member 162 is coupled to each of first and second offset members 202 and 206, respectively, as shown by arrow 212 and foam rail 164 is coupled to support member 162 as shown by arrow 214, thereby inclining foam rail support member 162 and foam rail 164 by offset angle 210. Inclined back support mechanism 144 facilitates stacking glass sheets (not shown) within shipping container 100 such that a substantial portion of induced weight forces are transferred to a rearward portion of shipping container 100.

In the exemplary embodiment, offset members 202 and 206 are unitary wooden members. Alternatively, offset members 202 and 206 have any configuration that enables operation of shipping container 100 as described herein including, without limitation, at least one portion of a 2×4 or a plurality of portions of 2×4 coupled together.

Figure 10:
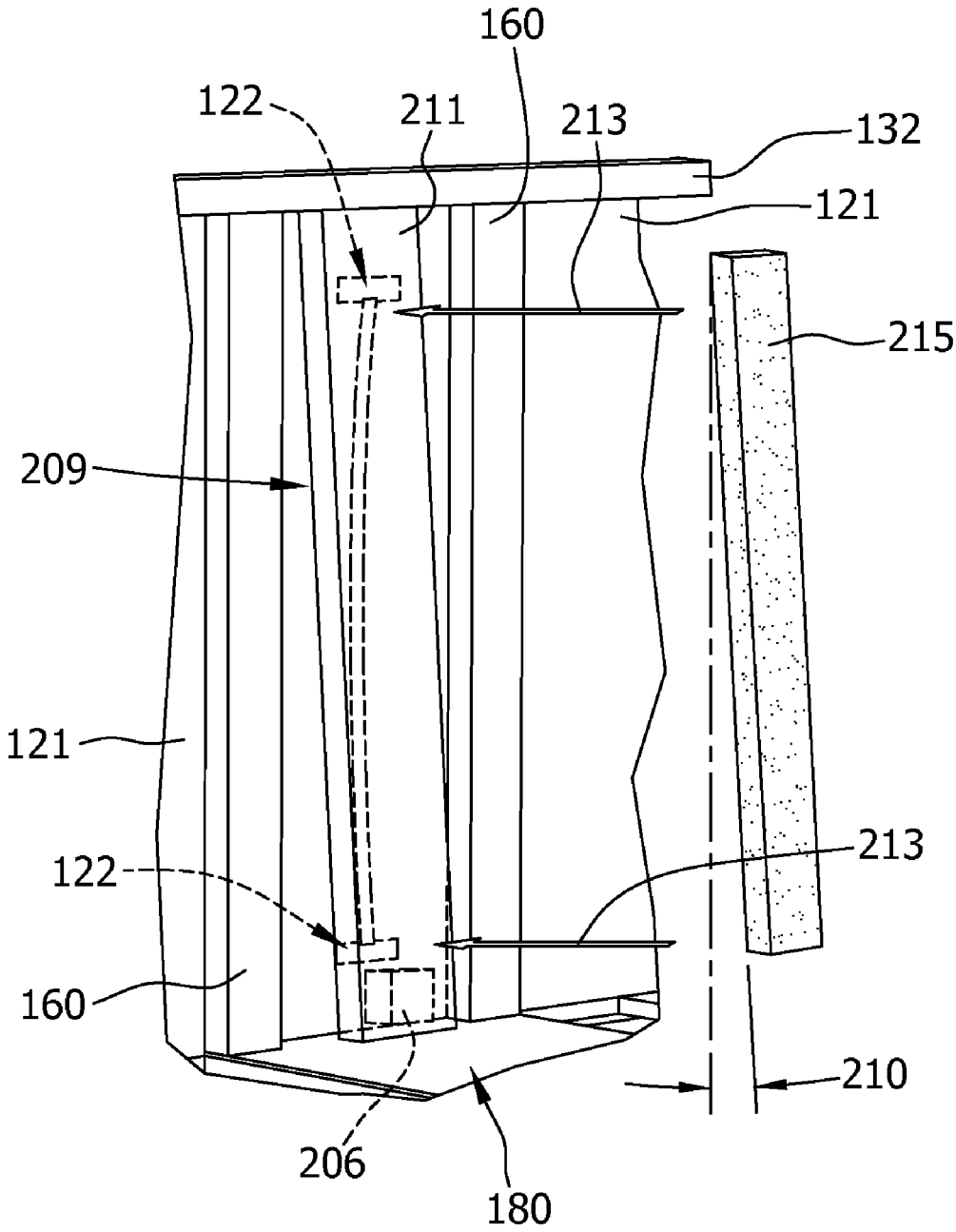
FIG. 10 is a perspective side view of an alternative back support mechanism that may be used with the glass shipping container shown in FIG. 1.

FIG. 10 is a perspective side view of an alternative back support mechanism 209 that may be used with glass shipping container 100 (in FIG. 1). In this exemplary alternative embodiment, a single back support mechanism 209 is coupled to back panel 120 (shown in FIG. 7), or more specifically, coupled to at least one of corrugated cardboard wall 121 and back support member 132 by any means that enables operation of shipping container 100 as described herein. Alternatively, any number of back support mechanisms 209 is used to enable operation of shipping container 100 as described herein, including, without limitation, two and three mechanisms 209. In the exemplary embodiment, each back support mechanism 209 is an angled backrest that has an approximately five degree incline 210 that is facilitated by a single offset member 206. Each back support mechanism 209 also includes a foam rail support member 211 coupled to at least one of corrugated cardboard wall 121, back support member 132, and/or floor support mechanism 180 by any means that enables operation of shipping container 100 as described herein. Each foam rail support member 211 is a wooden 2-inch by 6-inch member, that is, a wooden 2×6 that extends from horizontal back support member 132 to floor support mechanism 180. Each back support mechanism 209 further includes at least one foam rail 215 coupled to foam rail support member 211 as shown by arrow 213 by any means that enables operation of shipping container 100 as described herein including, without limitation, fastening hardware and adhesives. Each foam rail 215 extends from a predetermined distance below horizontal back support member 132 to floor support mechanism 180.

Figure 11:
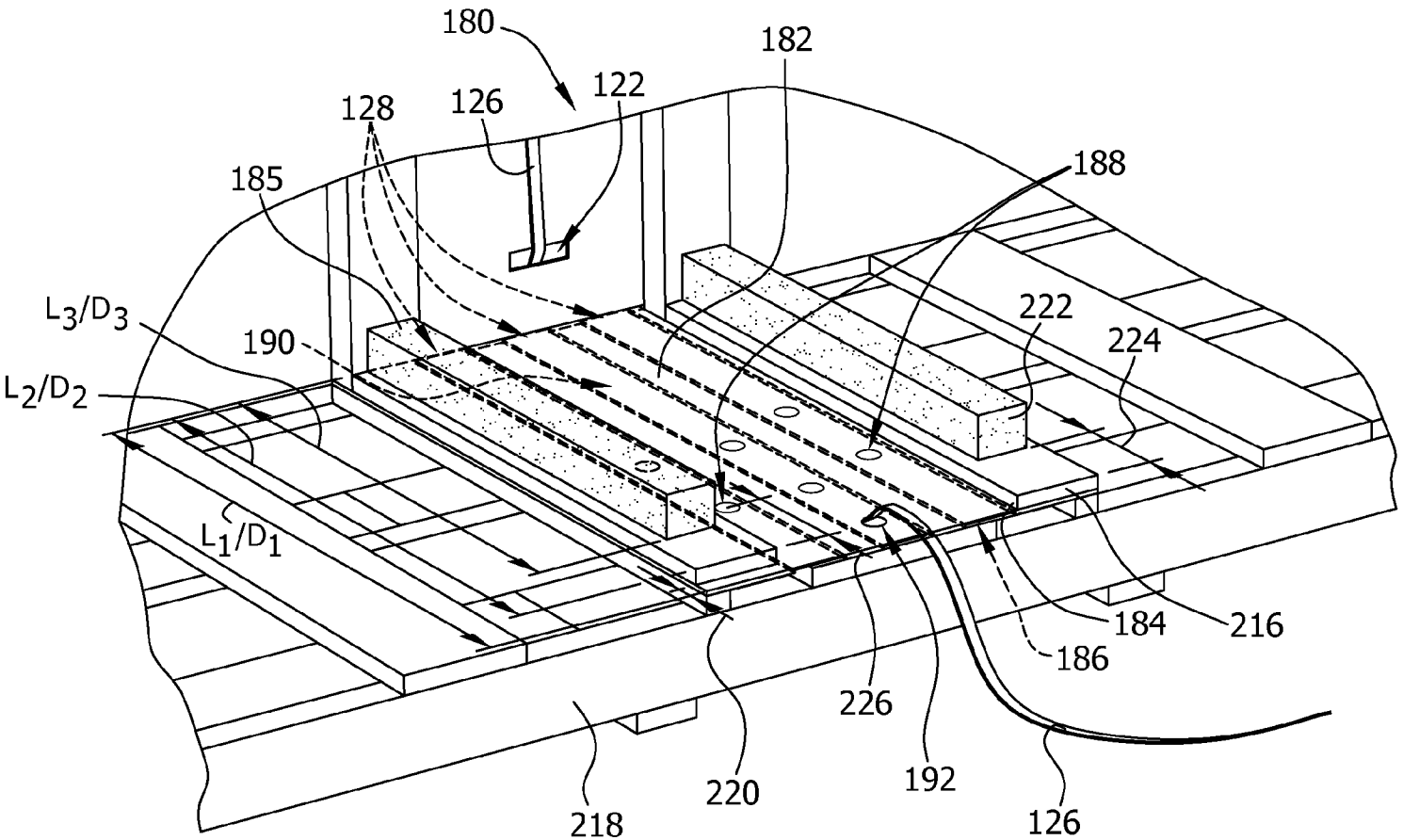
FIG. 11 is a perspective view of a floor support mechanism that is used with the glass shipping container shown in FIG. 1.
Figure 12:
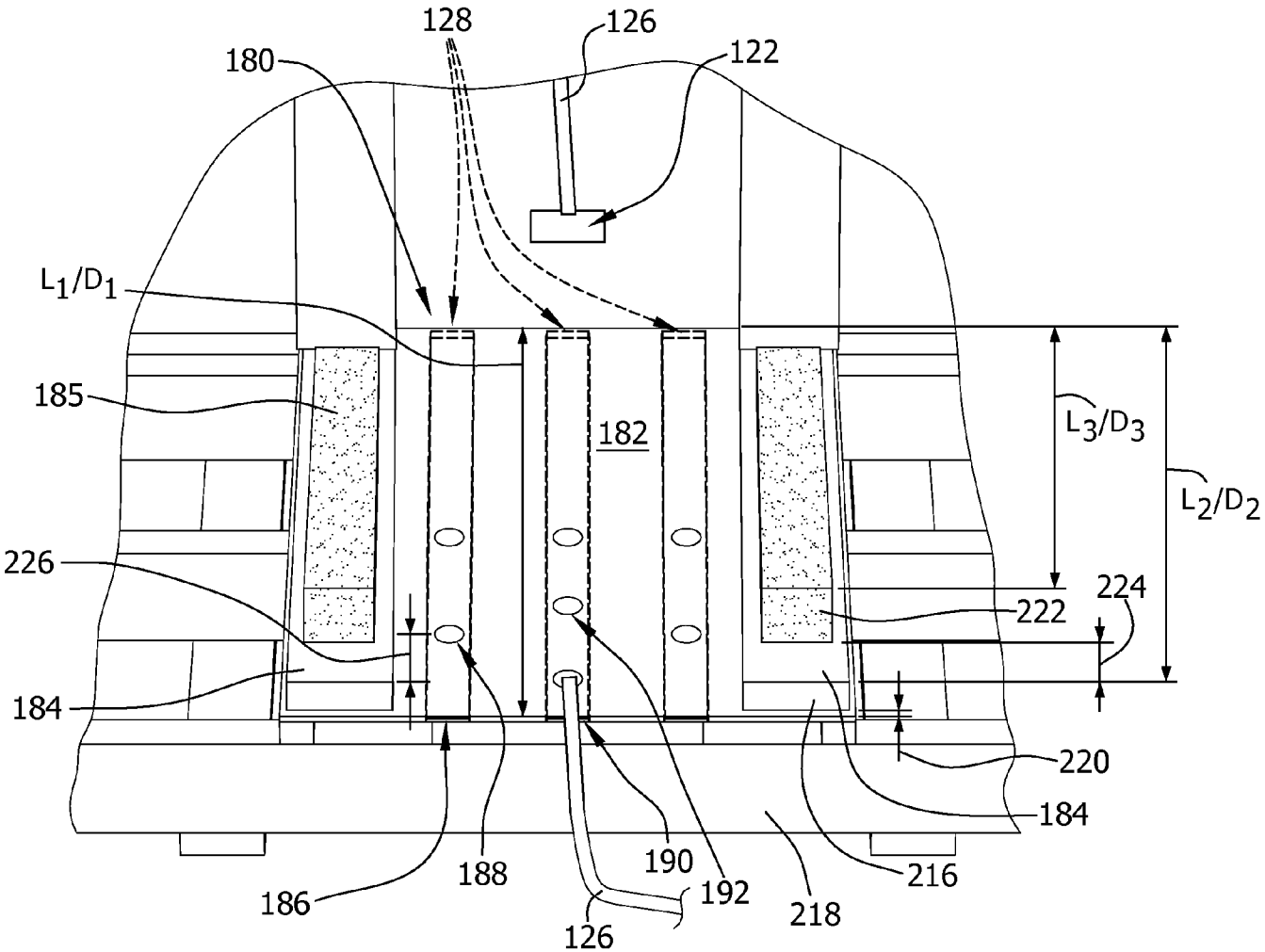
FIG. 12 is a front perspective view of the floor support mechanism shown in FIG. 11.

FIG. 11 is a perspective view of floor support mechanism 180 that is used with glass shipping container 100 (shown in FIG. 1). FIG. 12 is a front perspective view of floor support mechanism 180. In the exemplary embodiment, both horizontal support board 182 and bottom support pallet 106 have a first length $L_1$ that defines a first distance $D_1$ from back panel 120 to an outer front edge 218 of bottom support pallet 106. Also, in the exemplary embodiment, foam rail support member 184 has a second length $L_2$ that defines a second distance $D_2$ from back panel 120 and foam rail support member 184 includes an outer edge 216 that is proximate to outer front edge 218. Edges 216 and 218 and distances $D_1$ and $D_2$ define a distance 220 therebetween. Moreover, foam rail 186 has a third length $L_3$ that defines a third distance $D_3$ from back panel 120 and foam rail 186 includes an outer edge 222 that defines a distance 224 between edges 222 and 216 and $D_2$ and $D_3$. Distance 224 facilitates shifting induced weight forces from substantially transferring to horizontal support board 182 to transferring to a more robust portion of bottom support pallet 106 within distance 224. Furthermore, such stresses are shifted away from a portion of OSB horizontal support board 182 in the vicinity of banding guide holes 188, wherein an ability to withstand such stresses may be diminished, that is, a predetermined distance 226 between a front-most hole 188 and edge 216 of foam rail support member 184. Distances 220, 224, and 226 have any values that enable operation of shipping container 100 as described herein.

The above-described container provides a glass shipping container formed from a plurality of wooden members and corrugated cardboard. More specifically, the shipping container as described herein includes a bottom, or floor support mechanism that facilitates supporting the transported glass sheets above a bottom support pallet. Also, the floor support mechanism enables banding straps to be routed around the glass sheets, through holes and grooves formed in an oriented strand board (OSB) member, and to an outer anchoring portion of the shipping container, thereby improving the loading and securing the glass sheets therein. Further, specifically, the floor support mechanism is configured to strengthen the shipping container while shifting induced weight forces though the reinforced portions of the OSB member and to a reinforced portion of the bottom support pallet. Moreover, the shipping container as described herein includes an inclined back support mechanism that facilitates stacking glass sheets within the shipping container such that a substantial portion of the induced weight forces are transferred to the rear of the shipping container. The shipping container as described herein further includes a top support member that strengthens the shipping container and reduces the potential for damage t the glass sheets during transport.

Exemplary embodiments of a container formed to contain glass sheets therein are described above in detail. The container is not limited to the specific embodiments described herein, but rather, components of the container may be utilized independently and separately from other components described herein. For example, the container features may also be used in combination with other types of containers, and is not limited to practice with only rectangular containers, as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container for transporting glass sheets, said container comprising:

a bottom structure having a front edge;

a back wall extending upwardly from said bottom structure;

a first side wall coupled to said back wall and extending upwardly from said bottom structure;

a second side wall opposite said first side wall coupled to said back wall and extending upwardly from said bottom structure;

a floor support mechanism coupled to said bottom structure, said floor support mechanism comprising:

at least one floor support member extending substantially horizontally from said back wall a first distance proximate to said front edge of said bottom structure;

at least one foam rail support member coupled to said at least one floor support member, wherein said at least one foam rail support member extends substantially horizontally from said back wall a second distance proximate to said front edge of said bottom structure; and at least one foam rail coupled to said at least one foam rail support member, wherein said at least one foam rail extends substantially horizontally from approximately said back wall a third distance that is less than said second distance, wherein said floor support mechanism facilitates transferring a load exerted by the glass sheets to at least a portion of said bottom structure.

2. A container for transporting glass sheets in accordance with claim 1, wherein said second distance at least partially defines a predetermined distance from said front edge.

3. A container for transporting glass sheets in accordance with claim 1, wherein said at least one floor support member defines at least one aperture, wherein said aperture is a predetermined distance from said at least one foam rail support member.

4. A container for transporting glass sheets in accordance with claim 1, wherein said at least one floor support member defines at least one first aperture, at least one second aperture, and a channel therebetween, wherein said first and second apertures and said channel are configured to route banding.

5. A container for transporting glass sheets in accordance with claim 4, wherein:

said at least one foam rail comprises two foam rails positioned on said at least one support member; and said channel comprises two channels, wherein each of said channels is positioned between said two foam rails.

6. A container for transporting glass sheets in accordance with claim 1 further comprising a removable front panel coupled to at least a portion of at least one of said first side wall and said second side wall and extending therebetween.

7. A container for transporting glass sheets in accordance with claim 1, wherein said at least one floor support member comprises an oriented strand board (OSB).

8. A container for transporting glass sheets, said container defining an internal volume and comprising:

a bottom structure;

a back wall extending upwardly from said bottom structure;

a first side wall coupled to said back wall and extending upwardly from said bottom structure;

a second side wall opposite said first side wall coupled to said back wall and extending upwardly from said bottom structure; and a back support structure coupled to said back wall and configured to constrain a plurality of glass sheets, said back support structure comprising:

at least one back support member, said at least one back support member extending in a substantially vertical direction;

a first offset member extending inwardly a first horizontal distance from said at least one back support member toward the internal volume of said container;

a second offset member positioned below said first offset member and extending inwardly a second horizontal distance from said at least one back support member toward the internal volume of said container, wherein the second distance is greater than the first distance; and at least one foam rail coupled to a foam rail support member, said foam rail support member is coupled to said first offset member and said second offset member.

9. A container for transporting glass sheets in accordance with claim 8, wherein said back wall is substantially vertical and said back support structure defines a predetermined offset angle with said back wall.

10. A container for transporting glass sheets in accordance with claim 8, wherein said foam rail support member extends from said bottom structure to at least one of:

a horizontal back support member positioned at an uppermost portion of said back wall; and a position along said back wall below said horizontal back support member.

11. A method of assembling a container for transporting glass sheets, the container defines an internal volume, said method comprising:

providing a bottom structure having a front edge;

coupling a back wall to the bottom structure and extending the back wall upwardly therefrom;

coupling a first side wall to the back wall and extending the first side wall upwardly from the bottom structure;

coupling a second side wall to the back wall and extending the second side wall upwardly from the bottom structure, wherein the first and second side walls are opposite to each other; and assembling a floor support mechanism comprising:

coupling at least one floor support member to the bottom structure, the at least one floor support member extending substantially horizontally from the back wall a first distance proximate to the front edge of the bottom structure;

coupling at least one foam rail support member to the at least one floor support member, wherein the at least one foam rail support member extends substantially horizontally from the back wall a second distance proximate to the front edge of the bottom structure; and coupling a foam rail to the at least one foam rail support member, wherein the at least one foam rail extends substantially horizontally from approximately the back wall a third distance that is less than the second distance.

12. A method in accordance with claim 11, wherein coupling at least one foam rail support member to the at least one floor support member comprises positioning at least one foam rail support member a predetermined distance from the front edge.

13. A method in accordance with claim 11 further comprising forming at least one aperture within the at least one floor support member, wherein the at least one aperture is a predetermined distance from the foam rail support member.

14. A method in accordance with claim 11 further comprising forming at least one first aperture within the at least one floor support member, forming at least one second aperture within the at least one floor support member, and forming a channel therebetween.

15. A method in accordance with claim 14, wherein coupling at least one foam rail support member to the at least one floor support member comprises:

coupling two foam rails on the at least one floor support member; and forming two channels between the two foam rails.

16. A method in accordance with claim 15 further comprising coupling a removable front panel to at least a portion of at least one of the first side wall and the second side wall and extending therebetween.

17. A method in accordance with claim 11, wherein coupling at least one floor support member to the bottom structure comprises coupling an oriented strand board (OSB) to the bottom structure.

18. A method in accordance with claim 11 further comprising:

assembling an inclined back support member comprising:

coupling at least one back support member to the back wall, the at least one back support member extending in a substantially vertical direction;

coupling a first offset member to the at least one back support member, thereby extending the first offset member inwardly a first distance from the at least one back support member toward the internal volume of the container;

coupling a second offset member to the floor support mechanism and below the first offset member, thereby extending the second offset member inwardly a second distance from the at least one back support member toward the internal volume of the container, wherein the second distance is greater than the first distance; and coupling at least one foam rail support member to each of the first offset member and the second offset member; and coupling at least one foam rail to the at least one foam rail support member.

19. A method in accordance with claim 18, wherein coupling at least one foam rail support member to each of the first offset member and the second offset member comprises forming a predetermined offset angle between the at least one foam rail member and the at least one back support member.

20. A method in accordance with claim 19, wherein the predetermined offset angle is approximately five degrees.

* * * * *